United States Patent [19]

Yamamoto

[11] Patent Number: 4,874,160

[45] Date of Patent: Oct. 17, 1989

[54] PAPER CARTRIDGE WITH PAPER ALIGNING MEANS

[75] Inventor: Kazushi Yamamoto, Osaka, Japan

[73] Assignee: Sharp Kabushiki Kaisha, Osaka, Japan

[21] Appl. No.: 119,536

[22] Filed: Nov. 12, 1987

[30] Foreign Application Priority Data

Nov. 20, 1986 [JP] Japan ..... 61-180294[U]

[51] Int. Cl.[4] ..... B65H 9/06

[52] U.S. Cl. ..... 271/227; 271/234; 271/240; 271/253; 271/171

[58] Field of Search ..... 271/171, 234, 236, 238, 271/240, 253, 254, 255, 223, 241, 227, 248; 221/241, 242

[56] References Cited

U.S. PATENT DOCUMENTS

| | | | |
|---|---|---|---|
| 3,617,048 | 11/1971 | Albert | 271/171 X |
| 4,607,834 | 8/1986 | Dastin | 271/171 |
| 4,657,239 | 4/1987 | Ikesue et al. | 271/240 X |

FOREIGN PATENT DOCUMENTS

| | | | |
|---|---|---|---|
| 0036037 | 2/1984 | Japan | 271/171 |
| 0128147 | 7/1984 | Japan | 271/240 |
| 0212331 | 12/1984 | Japan | 271/171 |
| 0203032 | 9/1986 | Japan | 271/171 |
| 2010228 | 6/1979 | United Kingdom | 271/171 |
| 2130182 | 5/1984 | United Kingdom | 271/171 |

*Primary Examiner*—Joseph J. Rolla
*Assistant Examiner*—Edward S. Ammeen
*Attorney, Agent, or Firm*—Flehr, Hohbach, Test, Albritton & Herbert

[57] ABSTRACT

A paper cartridge for a paper processing apparatus such as a copier includes a table on which sheets of paper are placed and two side plates and a back plate which are movable perpendicularly to and along the direction of their transportation, respectively, to arrange these sheets of paper at a desired position. Each of these plates is provided with a sensor for detecting the presence of a sheet and these plates are moved according to the outputs from these sensors.

9 Claims, 4 Drawing Sheets

PAPER CARTRIDGE WITH PAPER ALIGNING MEANS

BACKGROUND OF THE INVENTION

This invention relates to a paper cartridge which is a part of a paper transporting passageway formed inside an apparatus such as a copier and with which sheets of transported paper can be properly arranged and stored.

Inside an apparatus such as a copier which processes sheets of paper, rollers and guide members are provided to form a paper transporting passageway through which sheets of paper are sequentially transported from a supply section to a processing section and then to a discharge section. Such apparatus are usually adapted to transport many sheets of paper continuously and it is desirable to reduce the intervals between successive processing operations and to thereby improve the work efficiency. On the other hand, sheets of paper to be transported to the processing section must be positioned correctly all the time such that the operations at the processing section can be carried out properly. For this purpose, the positions of paper both in the direction of transportation and the perpendicular direction must be considered. In other words, each sheet of transported paper must be properly positioned regarding these two directions.

In conventional apparatus provided with a paper transporting passageway, positioning of paper in the direction of transportation is usually carried out by synchronizing the action timing of the processing section with the timing with which paper is transported. As for the perpendicular direction, regulating plates are usually provided to the storage table in the paper supply section such that the two parallel edges of the transported paper in the direction of transportation are defined and the sides of the supplied sheets will touch these two parallel plates. Such regulating plates are generally adapted to be operated manually but there have been apparatus such as a copier for making copies on both sides of sheets, having an intermediate tray which can be operated by a motor or the like according to the detected size of the transported sheet of paper.

If such regulating plates must be moved manually according to the size of the stored paper, the preparatory work for the operation becomes inconveniently complicated. If a motor or the like is used to move the regulating plates, only sheets of standard sizes such as A4 and B5 could be effectively handled and sheets of non-standard sizes could not be properly arranged.

SUMMARY OF THE INVENTION

It is therefore an object of the present invention to provide a paper cartridge with paper arranging capability with which the regulating plates can be automatically positioned according to the size of the transported sheets of paper, whether it is one of the standard sizes or not.

A paper cartridge of the present invention which achieves the above and other objects is comprised not only of a storage table for carrying transported sheets of paper thereon, two side plates adapted to respectively touch the two parallel side edges of the sheets on the storage table along the direction of transportation and to move in the perpendicular direction and a back plate adapted to touch the back edges of the sheets on the storage table and to move in the direction of transportation, but also of a first mechanism for moving the two side plates symmetrically with respect to a central axis in the direction of transportation, a second mechanism for moving the back plate in the direction of transportation, detectors which are attached to the side and back plates to detect the edges of the sheets and control devices for activating the first and second mechanisms according to the outputs of the detectors.

With a cartridge thus structured, the side plates which contact the parallel sides of the paper in the direction of transportation can be moved in the perpendicular direction by one (first) of the plate-moving mechanisms and the back plate which contacts the back sides of the paper can be moved in the direction of transportation by the other (second) of the plate-moving mechanisms. Each of these plates is provided with a paper-edge detector and the plate-moving mechanisms move the plates according to the outputs from these detectors, or the results detected thereby. In other words, these detectors control the distances by which these plates are moved perpendicularly to the directions of their plane surfaces.

BRIEF DESCRIPTION OF THE DRAWINGS

The accompanying drawings, which are incorporated in and form a part of the specification, illustrate in embodiment of the present invention and, together with the description, serve to explain the principles of the invention. In the drawings.

DETAILED DESCRIPTION OF THE INVENTION

Figure 1:
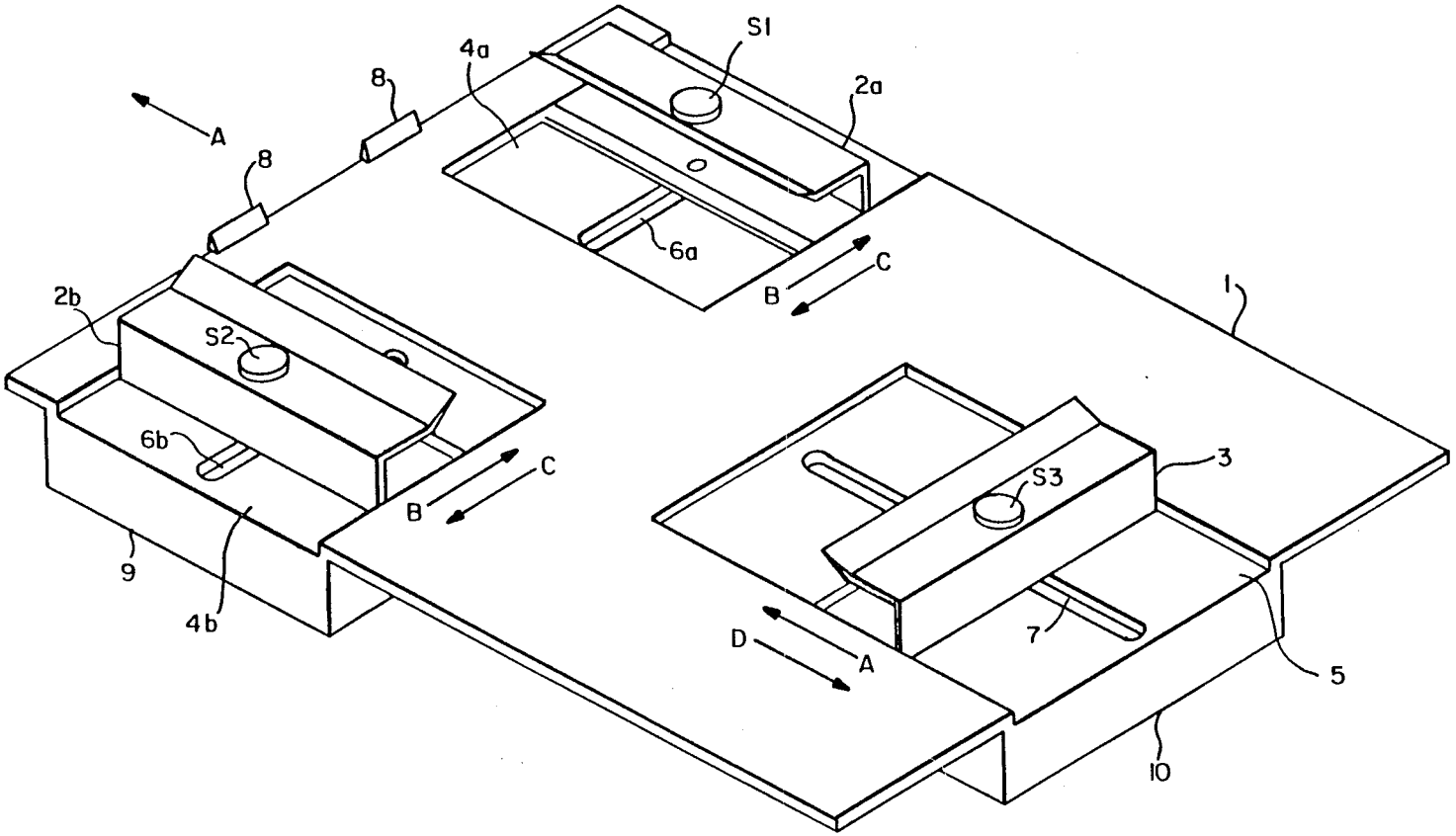
FIG. 1 is a diagonal external view of a paper cartridge embodying the present invention.

With reference to FIG. 1, sheets of paper (not shown) placed on a paper table 1 are transported in the direction of Arrow A. The upper surface of the table 1 is formed symmetrically with respect to a central axis in the direction of Arrow A. For example, there are two step-wise indented sections 4*a* and 4*b* symmetrically formed at the forward (in the direction of Arrow A) end of the table 1 with elongated holes 6*a* and 6*b* respectively formed therein. Two side plates 2*a* and 2*b* are provided with protruding pieces (not shown) inserted respectively into the elongated holes 6*a* and 6*b* such that they can be moved within the indented sections 4*a* and 4*b* in the directions of Arrows B and C perpendicular to Arrow A. Numerals 8 indicate gates provided at two positions on the frontal edge of the table 1.

At the backward end of the table 1 is another step-wise indented section 5 provided also with an elongated hole 7 in the direction of Arrow A. A back plate 3 is similarly provided with a protruding piece (not shown) inserted into this elongated hole 7 such that this back plate 3 can be moved within this indented section 5 reciprocatingly in the directions of Arrows A and D. The side and back plates 2*a*, 2*b* and 3 are all approximately U-shaped in the cross-section.

The side plates 2a and 2b are individually provided with sensors S1 and S2 and the back plate 3 is provided with another sensor S3. These sensors S1, S2 and S3 are adapted to detect edge sections of a sheet of paper. A protrusion 9 is formed on the lower surface of the table 1 corresponding to the step-wise indented sections 4a and 4b. Another protrusion 10 is formed corresponding to the step-wise indented section 5.

Figure 2A:
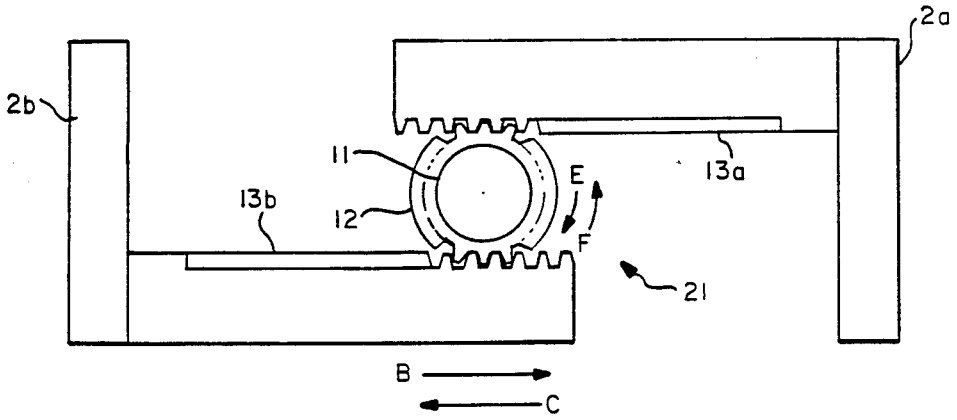
FIGS. 2A and 2B are schematic plan views of the mechanisms for moving the side and back plates, respectively, which are parts of the paper cartridge of FIG. 1.

The protrusion 9 on the lower surface of the table 1 contains a side-plate moving mechanism 21, including as shown in FIG. 2A a pulse motor 11 capable of rotating both in a positive direction and a negative direction, a pinion gear 12 affixed to the axis of the motor 11 and rack gears 13a and 13b engaging with the pinion gear 12. The pinion gear 12 rotates in the direction of Arrow E or F, depending on whether the motor 11 rotates in the positive or negative direction. The rack gears 13a and 13b are affixed respectively to the side plates 2a and 2b. The rack gear 13a, engaging with the pinion gear 12, moves in the direction of Arrow B when the motor 11 rotates in the positive direction. Similarly, the other rack gear 13b and the side plate 2b move in the direction of Arrow C when the motor 11 rotates in the positive direction. When the motor 11 rotates in the negative direction, the rack gear 13a and the side plate 2a move in the direction of Arrow C and the rack gear 13b and the side plate 2b move in the direction of Arrow B. In other words, the two side plates 2a and 2b always move in mutually opposite directions and since the rack gears 13a and 13b both engage with the pinion gear 12, they move at the same speed.

Figure 2B:
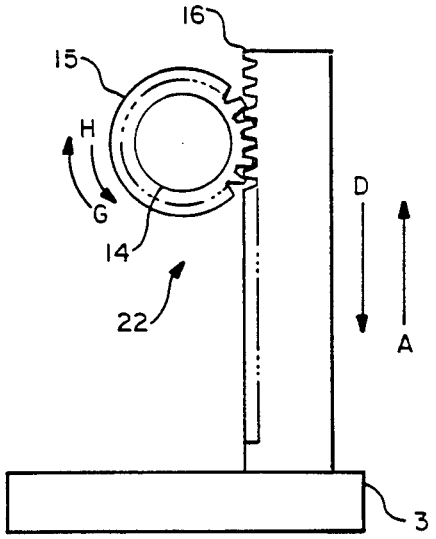

The protrusion 10 formed at the backward end of the table 1 contains therein a back-plate moving mechanism 22, including as shown in FIG. 2B another pulse motor 14, a pinion gear 15 and a rack gear 16. The pinion gear 15 is affixed to the axis of the motor 14 and hence is adapted to rotate both in the positive and negative directions. The rack gear 16 not only engages with the pinion gear 15 but is affixed to the back plate 3. As the motor 14 rotates in the positive or negative direction, the pinion gear 15 rotates accordingly in the direction of Arrow G or H. Thus, if the motor 14 rotates in the positive direction, the rack gear 16 and the back plate 3 move in the direction of Arrow D and if the motor 14 rotates in the negative direction, the rack gear 16 and the back plate 3 move in the direction of Arrow A.

Figure 3:
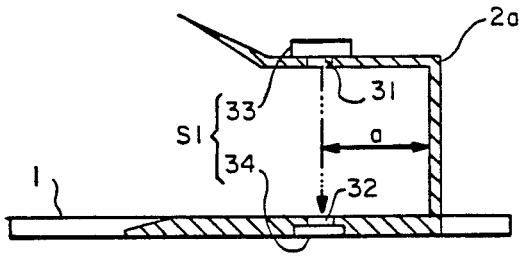
FIG. 3 is a sectional view of a detector which is a part of the paper cartridge of FIG. 1.

With reference next to FIG. 3 which is a sectional view of a part of the side plate 2a inclusive of the sensor S1 thereon, the side plate 2a is U-shaped cross-sectionally as mentioned above, and its upper and lower surfaces are provided with openings 31 and 32, respectively. A light emitting element 33 and a light receiving element 34 forming the sensor S1 are respectively disposed opposite to these openings 31 and 32 such that light emitted from the light emitting element 33 travels through the openings 31 and 32 and is received by the light receiving element 34. If the edge of a sheet of paper placed on the table 1 blocks this propagation of light, the sensor S1 is switched on. The openings 31 and 32 are so positioned that the line connecting them is at a predetermined distance a away from the inner surface of the vertical portion of the side plate 2a. The other side plate 2b with the sensor S2 and the back plate with the sensor S3 are similarly structured.

Figure 4:
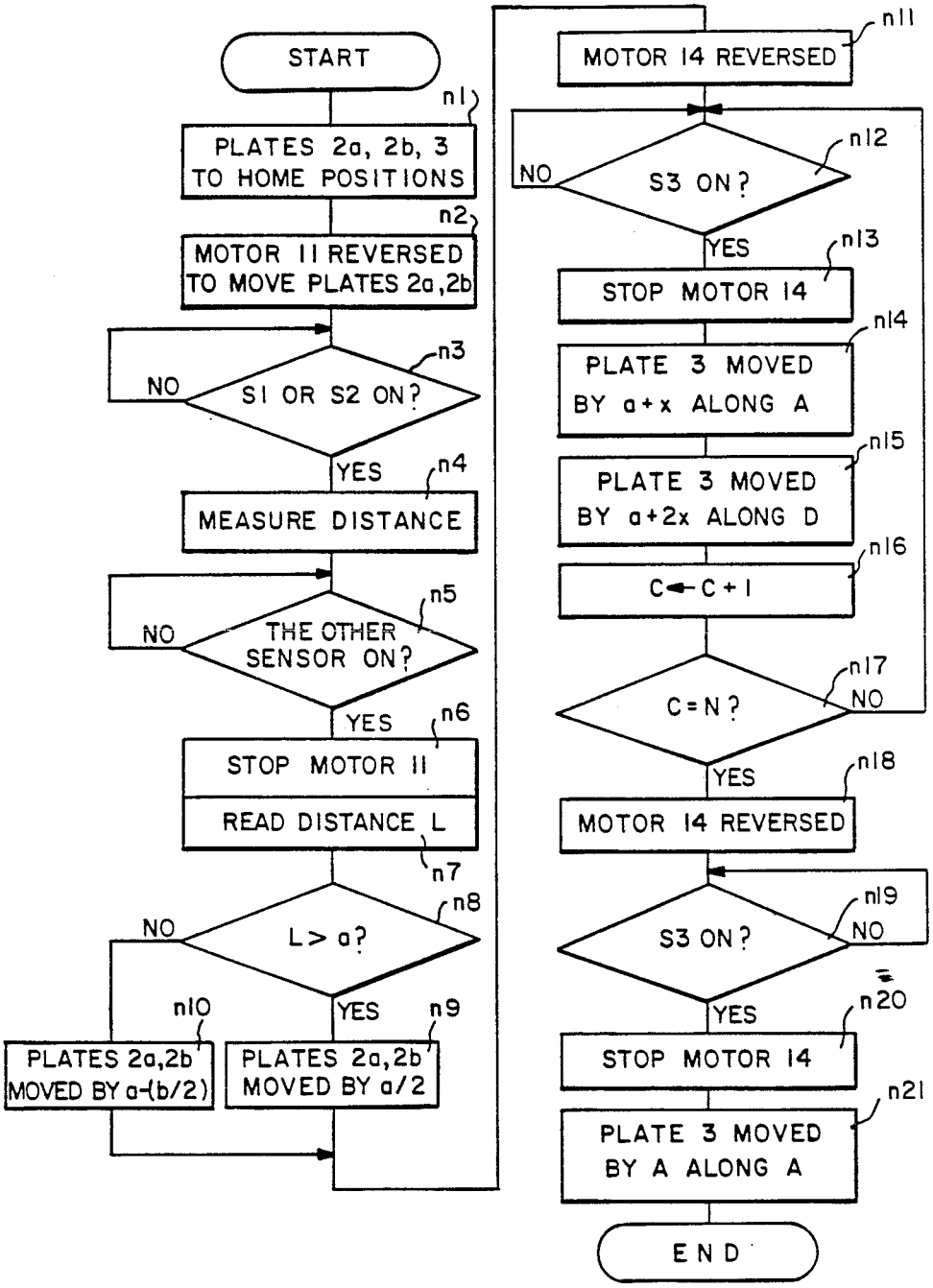
FIG. 4 is a flowchart of the operation of the paper cartridge of FIG. 1.

Next, the operation of the paper cartridge described above is explained by way of the flowchart shown in FIG. 4. When a command is received to properly arrange the sheets of paper placed on the table 1, the side plates 2a and 2b and the back plate 3 are moved to their respective home positions (n1). By their home positions are intended to mean the farthest positions these plates 2a, 2b and 3 can move to in the directions of Arrows B, C and D, respectively. In this step, the motors 11 and 14 are both rotated in the positive clockwise direction. When the plates 2a, 2b and 3 reach their home positions, the motor 11 is reversed such that the side plates 2a and 2b are moved in the directions of Arrows C and B, respectively (n2). When either of the sensors S1 and S2 detects the presence of paper on the table 1 (n3), measurement of the distance traveled by the side plates 2a and 2b is started (n4). Thereafter, when the other of the sensors S1 and S2 is also switched on (n5), the motor 11 is stopped (n6) and the distance L traveled by the side plates 2a and 2b is determined (n7). If the determined distance L is greater than the distance a (YES in n8), the side plates 2a and 2b are each moved by a/2 (n9). If L is no greater than a, on the other hand, the side plates 2a and 2b are moved in the directions of Arrows C and B, respectively, by a−(b/2) (n10). Steps n8–n10 are the operations of what may be referred to as the side plate control means.

Figure 5:
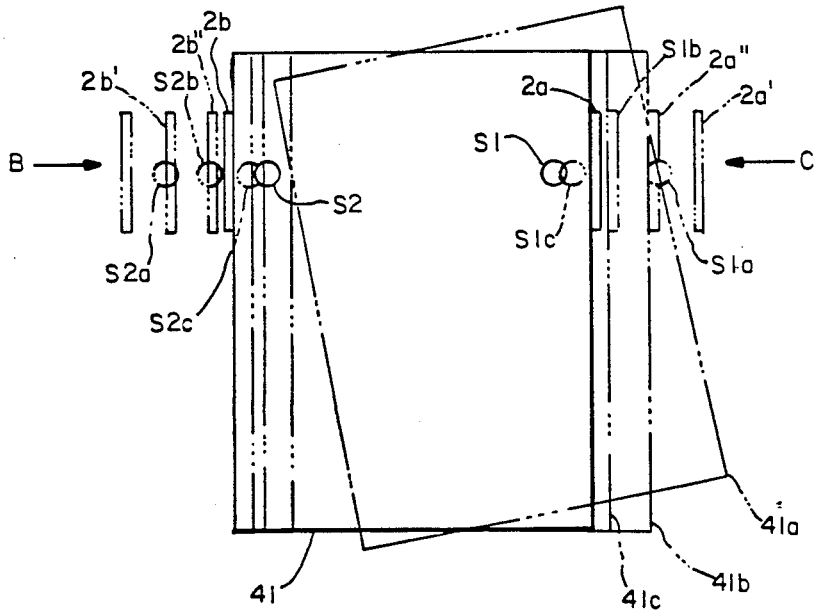
FIG. 5 is a plan view for showing the operation of the side plate of the paper cartridge of FIG. 1.

If a sheet 41 is placed on the table 1 as indicated by numeral 41a in FIG. 5, the side plates 2a and 2b move in the directions of Arrows C and B, respectively, at the same speed. When the side plate 2a reaches the position indicated by 2a', its sensor S1 detects an edge of the paper 41a at the position S1a. This is when the measurement of distance is started and the side plate 2a is moved in the direction of Arrow C. When it reaches the position 2a'', its vertical surface strikes the side edge of the sheet 41b. At this moment, the other side plate 2b is at the position indicated by 2b' and its sensor S2 at S2b such that the sheet at the position 41b is not detected by it.

When the motion of the side plates 2a and 2b in the directions of Arrows C and B is further resumed and the sheet 41 reaches the position indicated by 41c, the side plate 2b is at the position indicated by 2b'' and its sensor S2 at the position indicated by S2c detects the paper 41c. This causes the motor 11 to stop and the distance L traveled by the plates 2a and 2b between when the sensor S1 is switched on and when the other sensor S2 is switched on. If L is greater than a, or if the vertical section of the side plate 2a touches the sheet, the side plates 2a and 2b each move by a/2 in the directions of Arrows C and B, respectively, until the sheet comes to the position indicated by 41 where it is in contact with both of the side plates 2a and 2b on both sides and is oriented in the direction of transportation along Arrow A.

After the sheets are oriented in the direction of transportation by the operations of the side plates 2a and 2b, the motor 14 is rotated in the counter-clockwise direction and the back plate 3 approaches the back edge of the sheets (n11). When the sensor S3 detects the back edge of a sheet and is switched on (n12), the motor 14 is temporarily stopped (n13) and the back plate 3 is thereafter moved by (a+x) in the direction of Arrow A (n14) where x indicates a predefined small distance such that the front edge of the sheet strikes the gates 8. Next, the plate 3 is moved by (a+2x) in the direction of Arrow D (n15). The series of operations n12–n15 is repeated a predefined number N of times, controlled by a counter C (n16–n17).

After the back plate 3 repeats this reciprocating motion N times in the directions of Arrows A and D, the motor 14 is reversed (n18) and when the sensor S3 is switched on (n19), the motor 14 is temporarily stopped (n20) and the back plate 3 is moved by a in the direction of Arrow A (n21). This completes the arrangement of the sheets 41. Steps n12–n15 and n19–n21 are the operations of what may be referred to as the back-plate control means.

If the back plate 3 is thus moved back and forth several times after the sensor S3 detects the back edge of a sheet, the sheets are moved in the direction of transportation between the vertical inner wall of the back plate and the gates 8 and the front and back edges of the sheets repeatedly strike them. In this way, all sheets placed on the table 1 can be arranged at a proper position in the direction of transportation.

In summary, the side and back plates according to the present invention are moved according to how the sensors individually attached to them detect the presence of a sheet. Thus, these plates can be moved automatically to arrange the sheets at a proper position on the table and the initial operation for transporting paper can be simplified.

The foregoing description of a preferred embodiment of the invention has been presented for purposes of illustration. and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. In a paper cartridge comprising a table for placing and storing thereon sheets of paper transported along a paper transporting passageway which defines a direction of transportation, two side plates parallel to said direction of transportation adapted to individually contact the two edges of sheets placed on said table, and to move perpendicularly to said direction of transportation, and a back plate adapted to contact the back edges of sheets placed on said table and to move in said direction of transportation, the improvement wherein said paper cartridge further comprises a first mechanism for moving said two side plates symmetrically with respect to a central axis along said direction of transportation, a second mechanism for moving said back plate along said direction of transportation, detectors attached to said side and back plates and adapted to detect edges of sheets, and side-plate and back-plate control means for operating said first and second mechanisms, respectively, according to outputs from said detectors, said control means being so programmed as to automatically operate said mechanisms when sheets of paper are placed on said table to move said side and back plates away from one another to home positions thereof, to thereafter move said side plates towards each other while measuring a distance L traveled by said side plates between a first point in time when one of said detectors attached to one of said side plates detects a sheet and a second point in time when another one of said detectors attached to the other of said side plates detects said sheet, and to further move said side plates by a/2 if L is greater than a, a being a distance determined by the positions of said detectors on the respective ones of said plates.

2. The paper cartridge of claim 1 wherein each of said detectors comprises a light emitting element and a light receiving element.

3. The paper cartridge of claim 1 wherein said two side plates are disposed symmetrically with respect to said central axis.

4. The paper cartridge of claim 1 wherein said two side plates include rack gears which engage to a pinion gear affixed to the axis of a pulse motor.

5. In a paper cartridge comprising a table for placing and storing thereon sheets of paper transported along a paper transporting passageway which defines a direction of transportation, two side plates parallel to said direction of transportation adapted to individually contact the two edges of sheets placed on said table, and to move perpendicularly to said direction of transportation, and a back plate adapted to contact the back edges of sheets placed on said table and to move in said direction of transportation, the improvement wherein said paper cartridge further comprises a first mechanism for moving said two side plates symmetrically with respect to a central axis along said direction of transportation, a second mechanism for moving said back plate along said direction of transportation, detectors attached to said side and back plates and adapted to detect edges of sheets, and side-plate and back-plate control means for operating said first and second mechanisms, respectively, according to outputs from said detectors, said control means being so programmed as to automatically operate said mechanisms when sheets of paper are placed on said table to move said side and back plates away from one another to home positions thereof, to thereafter move said side plates towards each other while measuring a distance L traveled by said side plates between a first point in time when one of said detectors attached to one of said side plates detects a sheet and a second point in time when another one of said detectors attached to the other of said side plates detects said sheet, and to further move said side plates by a/2 if L is greater than a, a being a distance determined by the positions of said detectors on the respective ones of said plates, to move said back plate in said direction of transportation until one of said detectors attached to said back plate detects a sheet, to thereafter repeatedly move said back plate by a distance a+x in said direction of transportation where x is a predetermined distance and by another 2a+x opposite said direction of transportation, to thereafter move said back plate in said direction of transportation until one of said detectors attached to said back plate detects a sheet, and thereafter to move said back plate by a in said direction of transportation.

6. The paper cartridge of claim 5 wherein each of said detectors comprises a light emitting element and a light receiving element.

7. The paper cartridge of claim 5 wherein said two side plates are disposed symmetrically with respect to said central axis.

8. The paper cartridge of claim 5 wherein said two side plates include rack gears which engage to a pinion gear affixed to the axis of a pulse motor.

9. The paper cartridge of claim 5 further comprising gate pieces at a downstream edge of said table along said direction of transportation and said distance x is such that said sheet strikes said gate pieces when moved by said distance a+x.

* * * * *